US011319490B2

(12) United States Patent
Mahfouz et al.

(10) Patent No.: US 11,319,490 B2
(45) Date of Patent: May 3, 2022

(54) INTEGRATED PROCESS FOR MESOPHASE PITCH AND PETROCHEMICAL PRODUCTION

(71) Applicants: Saudi Arabian Oil Company, Dhahran (SA); King Abdullah University of Science and Technology (KAUST), Thuwal (SA)

(72) Inventors: Remi Mahfouz, Thuwal (SA); Ola Ali, Thuwal (SA); Isidoro Morales Osorio, Thuwal (SA); Wei Xu, Thuwal (SA); Xinglong Dong, Thuwal (SA); Yu Han, Thuwal (SA)

(73) Assignees: SAUDI ARABIAN OIL COMPANY, Dhahran (SA); KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 0 days.

(21) Appl. No.: 17/141,963

(22) Filed: Jan. 5, 2021

(65) Prior Publication Data

US 2021/0122981 A1 Apr. 29, 2021

Related U.S. Application Data

(62) Division of application No. 16/117,702, filed on Aug. 30, 2018, now Pat. No. 10,913,901.

(Continued)

(51) Int. Cl.

*C10C 3/00* (2006.01)
*C10C 3/02* (2006.01)

(Continued)

(52) U.S. Cl.

CPC ..... *C10C 3/002* (2013.01); *C10C 3/026* (2013.01); *C10G 11/18* (2013.01); *C10G 31/06* (2013.01);

(Continued)

(58) Field of Classification Search

CPC ..... B01J 19/0013; B01J 19/24; B01J 19/247; C10C 3/00; C10C 3/002; C10C 3/026;

(Continued)

(56) References Cited

U.S. PATENT DOCUMENTS 1,842,105 A 1/1932 Loomis
3,617,493 A 11/1971 Wirth et al.

(Continued)

FOREIGN PATENT DOCUMENTS

CN 104498072 A 4/2015
CN 104818041 A 8/2015

(Continued)

OTHER PUBLICATIONS

The International Search Report and Written Opinion for related PCT application PCT/US2018/038231 dated Sep. 26, 2018.

(Continued)

*Primary Examiner* — Prem G Singh
*Assistant Examiner* — Brandi M Doyle
(74) *Attorney, Agent, or Firm* — Bracewell LLP; Constance G. Rhebergen

(57) ABSTRACT

An integrated method for mesophase pitch and petrochemicals production. The method including supplying crude oil to a reactor vessel; heating the crude oil in the reactor vessel to a predetermined temperature for a predetermined amount of time; reducing asphaltene content in the crude oil by allowing polymerization reactions to occur in the reactor vessel at an elevated pressure in the absence of oxygen; producing a three-phase upgraded hydrocarbon product comprising gas, liquid, and solid hydrocarbon components, where the liquid hydrocarbon component comprises deasphalted oil and the solid hydrocarbon component comprises mesophase pitch; separating the gas, liquid, and solid hydrocarbon components; directly utilizing the liquid hydrocar- (Continued)

bon component for petrochemicals production; and directly utilizing the solid hydrocarbon component for carbon artifact production.

17 Claims, 4 Drawing Sheets

Related U.S. Application Data

(60) Provisional application No. 62/562,002, filed on Sep. 22, 2017, provisional application No. 62/557,442, filed on Sep. 12, 2017.

(51) Int. Cl.

| | |
|---|---|
| ***C10G 69/04*** | (2006.01) |
| ***C10G 31/06*** | (2006.01) |
| ***D01F 9/155*** | (2006.01) |
| ***C10G 11/18*** | (2006.01) |
| ***C10G 55/02*** | (2006.01) |

(52) U.S. Cl.
CPC ..... *C10G 55/02* (2013.01); *C10G 69/04* (2013.01); *D01F 9/155* (2013.01); *C10G 2300/104* (2013.01); *C10G 2300/1033* (2013.01); *C10G 2300/1044* (2013.01); *C10G 2300/206* (2013.01); *C10G 2400/02* (2013.01)

(58) Field of Classification Search
CPC ..... D01F 9/155; C10G 69/04; C10G 31/06; C10G 55/02; C10G 11/18; C10G 2300/1033; C10G 2300/104; C10G 2300/1044; C10G 2300/206; C10G 2400/02
See application file for complete search history.

(56) References Cited

U.S. PATENT DOCUMENTS

| | | | | |
|---|---|---|---|---|
| 3,974,264 | A | 8/1976 | McHenry | |
| 4,026,788 | A | 5/1977 | McHenry | |
| 4,049,538 | A | 9/1977 | Hayashi et al. | |
| 4,134,824 | A | 1/1979 | Kamm et al. | |
| 4,209,500 | A | 6/1980 | Chwastiak | |
| 4,217,204 | A | 8/1980 | Sakai et al. | |
| 4,303,631 | A | 12/1981 | Lewis et al. | |
| 4,317,809 | A * | 3/1982 | Lewis | C10C 3/002 208/39 |
| 4,426,278 | A | 1/1984 | Kosters | |
| 4,518,483 | A * | 5/1985 | Dickakian | C10C 3/002 208/22 |
| 4,551,225 | A | 11/1985 | Dickakian | |
| 4,801,372 | A | 1/1989 | Tate et al. | |
| 4,904,371 | A | 2/1990 | Kalback | |
| 4,931,162 | A | 6/1990 | Romine | |
| 4,991,095 | A | 2/1991 | Swanson | |
| 5,198,101 | A | 3/1993 | Kalback | |
| 5,259,947 | A | 11/1993 | Kalback | |
| 5,437,780 | A | 8/1995 | Southard et al. | |
| 5,540,832 | A | 7/1996 | Romine | |
| 5,540,903 | A | 7/1996 | Romine | |
| 6,018,497 | A | 1/2000 | Gunasekera | |
| 6,078,869 | A | 6/2000 | Gunasekera | |
| 6,106,561 | A | 8/2000 | Farmer | |
| 6,632,351 | B1 | 10/2003 | Ngan et al. | |
| 6,979,757 | B2 | 12/2005 | Powers | |
| 7,285,697 | B2 | 10/2007 | Keusenkothen | |
| 7,311,746 | B2 | 12/2007 | Stell et al. | |
| 7,318,891 | B1 * | 1/2008 | Malone | C10C 1/19 208/131 |
| 7,369,979 | B1 | 5/2008 | Spivey | |
| 7,381,320 | B2 | 6/2008 | Iqbal et al. | |
| 7,404,889 | B1 | 7/2008 | Powers | |
| 7,451,066 | B2 | 11/2008 | Edwards et al. | |
| 7,627,461 | B2 | 12/2009 | Guyaguler et al. | |
| 7,678,342 | B1 * | 3/2010 | Xu | C10G 11/18 422/139 |
| 7,744,747 | B2 | 6/2010 | Halsey | |
| 7,790,018 | B2 | 9/2010 | Khan | |
| 7,972,498 | B2 | 7/2011 | Buchanan et al. | |
| 8,285,532 | B2 | 10/2012 | Zangl et al. | |
| 8,396,699 | B2 | 3/2013 | Maliassov | |
| 9,284,499 | B2 | 3/2016 | Van Wees et al. | |
| 9,382,486 | B2 | 7/2016 | Bourane et al. | |
| 9,580,839 | B2 | 2/2017 | Bohnert et al. | |
| 2006/0036418 | A1 | 2/2006 | Pita et al. | |
| 2006/0235667 | A1 | 10/2006 | Fung et al. | |
| 2006/0282243 | A1 | 12/2006 | Childs et al. | |
| 2007/0090019 | A1 * | 4/2007 | Keusenkothen | C10G 9/14 208/106 |
| 2007/0265815 | A1 | 11/2007 | Couet et al. | |
| 2007/0271077 | A1 | 11/2007 | Kosmala et al. | |
| 2008/0277314 | A1 | 11/2008 | Halsey | |
| 2009/0050523 | A1 | 2/2009 | Halsey | |
| 2009/0248378 | A1 | 10/2009 | Li et al. | |
| 2010/0094605 | A1 | 4/2010 | Hajibeygi et al. | |
| 2010/0191511 | A1 | 7/2010 | Hsu et al. | |
| 2010/0250216 | A1 | 9/2010 | Narr et al. | |
| 2010/0312535 | A1 | 12/2010 | Chen et al. | |
| 2011/0011595 | A1 | 1/2011 | Huang et al. | |
| 2011/0015909 | A1 | 1/2011 | Zhao | |
| 2011/0024125 | A1 | 2/2011 | Wallace et al. | |
| 2012/0203518 | A1 | 8/2012 | Dogru | |
| 2012/0221302 | A1 | 8/2012 | Lewandowski et al. | |
| 2013/0085730 | A1 | 4/2013 | Shaw et al. | |
| 2013/0116993 | A1 | 5/2013 | Maliassov | |
| 2013/0124178 | A1 | 5/2013 | Bowen et al. | |
| 2013/0132049 | A1 | 5/2013 | Dogru | |
| 2015/0076031 | A1 | 3/2015 | Zhao et al. | |

FOREIGN PATENT DOCUMENTS

| | | | |
|---|---|---|---|
| CN | 105238430 | A | 1/2016 |
| CN | 105238431 | A | 1/2016 |
| DE | 3841677 | A1 | 6/1990 |
| JP | S59128208 | A | 7/1984 |
| JP | 6312689 | | 1/1988 |
| WO | 2000/063320 | A1 | 10/2000 |
| WO | 0063320 | A1 | 10/2000 |

OTHER PUBLICATIONS

The International Search Report and Written Opinion for related PCT application PCT/US2018/049925 dated Nov. 15, 2018.

Gonzalo L., et al., "Production of Carbon Fibers from Castilla's Crude-Oil Deasphalted Bottoms," Ciencia, Tecnologia y Futuro, Dec. 2002, vol. 2, No. 3, pp. 41-47.

Li, et al. "Preparation of the Mesophase Pitch by Hydrocracking Tail Oil from a Naphthenic Vacuum Residue." Energy & Fuels 29.7 (2015): 4193-4200.

Ming Li, et al., "Preparation of the Mesophase Pitch by Hydrocracking Tail Oil from a Naphthenic Vacuum Residue" Energy & Fuels, 2015, 29(7), pp. 4193-4200.

Park, Y. et al., "Catalytic cracking of lower-valued hydrocarbon s for producing light olefins"; Catalysis surveys, fi-om Asia, 14( 2), 2010, pp. 75-84.

Yong-Ki Park, et al., "Catalytic Cracking of Lower-Valued Hydrocarbons for Producing Light Olefins," Catalysis Surveys, Asia, 2010, 14(2), pp. 75-84.

* cited by examiner

INTEGRATED PROCESS FOR MESOPHASE PITCH AND PETROCHEMICAL PRODUCTION

PRIORITY

This application is a divisional application of U.S. patent application Ser. No. 16/117,702, filed on Aug. 30, 2018, which itself is a non-provisional application of and claims priority to and the benefit of U.S. Prov. App. Ser. Nos. 62/557,442 and 62/562,002, filed on Sep. 12, 2017 and Sep. 22, 2017, respectively, the entire disclosures of which are incorporated here by reference in their entirety.

BACKGROUND

Field

Embodiments of the disclosure relate to upgrading crude oil and crude oil residues. In particular, embodiments of the disclosure relate to upgrading crude oil and crude oil residues to produce mesophase pitch and additional petrochemicals in integrated processes.

Description of the Related Art

Crude oil and crude oil residues can be processed through energy intensive refining processes to produce mesophase pitch (also referred to as MP). The condensed aromatic nature of pitches provides thermal stability, such that mesophase pitch can be melt spun for use in carbon fiber applications. In some instances, melt spinning is preferred to wet/dry spinning, which is used in the production of polyacrylonitrile (PAN)-based fibers and involves large quantities of solvents and waste byproducts. High quality carbon fibers can be produced from optically anisotropic or mesophase pitch (MP), but production of this carbon fiber precursor has required extensive refining and complicated processing, which has made producing carbon fibers from mesophase pitch less desirable than producing PAN-based carbon fibers.

Carbon fibers combine high strength and tensile modulus with other desirable properties such as being lightweight, being chemically inert, having low thermal expansion, and having superior electrical and thermal conductivities. Smaller structural flaws in fiber form and enhanced molecular orientation allow for these properties and make carbon fibers suitable for a number of structural and functional applications.

In direct crude-oil-to-chemicals (C2C) technology, the heavy or asphaltenic fractions of crude oil are often problematic, causing reactor and heat surface fouling, catalyst deactivation, reduced cracking activity, and overall poor performance. Separation of these heavy cuts before the cracking reactor reduces the economic advantage of cracking crude oil directly to chemicals, or in other words C2C has cost more than cracking refinery products such as vacuum gas oil (VGO) and naphtha.

Challenges associated with crude cracking such as greater coking rate and metal poisoning of catalysts drive certain research efforts toward steam cracking (pyrolysis) and FCC. In some instances, economics of energy-intensive steam crackers are more favorable for lesser-value, heavier feedstocks such as crude oil. Practically, however, the asphaltic and nonvolatile fractions of these feedstocks can be disposed in tubes of a convection section of a pyrolysis furnace, therefore, impairing heat transfer and requiring frequent shutdowns. Some literature discusses addressing heavy residues in crude oil before applying steam crackers, and many references disclose a pre-separation step for non-volatile fractions in crude oil.

Direct catalytic cracking of crude oil is rarely discussed, because metals poisons, such as sulfur and nitrogen, in crude oil are detrimental to cracking catalysts and equipment. Cracking conventional feedstocks such as naphtha is already relatively easier than cracking crude oil and heavier feeds with residues, and by applying a pre-separation step for asphaltenes and metals in C2C processes, the economic and competitive advantage of skipping crude refining prior to cracking is largely removed.

SUMMARY

The disclosure presents thermal treatment systems and methods for the production of high quality mesophase pitch (MP) directly from crude oils or crude oil residues with or without hydrotreating, with simultaneous removal of asphaltenes, which decrease the viscosity and boiling point of heavy crude oils or residues. The solid (MP), liquid (deasphalted oil, DAO), and gas portions of products of such systems and methods can be fractionated into refinery products and used as feeds for direct C2C processes, including steam cracking processes and catalytic cracking processes. Processing crude oils and crude oil residues to produce mesophase pitch, which has a lesser boiling point, is desirable, and it can be used to produce high quality carbon fibers. DAO products can be used as gas oil directly, and can be used as a feedstock for a cracking process such as fluidized catalytic cracking (FCC) or pyrolysis.

New thermal pre-treatment methods, processes, and systems are disclosed for the production of high quality MP directly from crude oils or their residues with or without hydrotreating (HT). Embodiments of the present disclosure demonstrate that deasphalted oils (DAO) produced during methods of the disclosure can be used directly as feed to cracking furnaces, thus solving certain coking problems associated with direct crude oil cracking. Mesophase pitch is a valuable byproduct produced during embodiments of the disclosure, which boosts the efficiency of the processes.

In embodiments of the present disclosure, heavy crude oil, such as for example Arabian heavy (AH) crude oil is converted directly into valuable compounds using heat and pressure. The resulting product in a treatment vessel contains a solid phase at room temperature representing about 10 weight percent±5 weight percent of the obtained carbon fraction (depending on the feed, temperature, and time of polymerization). The liquid phase ("cut") represents about 80 weight percent±5 weight percent of the obtained carbon fraction, and the gas phase is about 10 weight percent±5 weight percent of the obtained carbon fraction. Liquid and gas portions of products of such processes can be fractionated into petrochemical feedstocks or used as feeds for direct C2C processes including steam pyrolysis and catalytic cracking processes (such as FCC).

Therefore, disclosed here is an integrated method for mesophase pitch and petrochemicals production, the method comprising the steps of: supplying crude oil to a reactor vessel; heating the crude oil in the reactor vessel to a predetermined temperature for a predetermined amount of time; reducing asphaltene content in the crude oil by allowing polymerization reactions to occur in the reactor vessel at an elevated pressure in absence of oxygen; producing a three-phase upgraded hydrocarbon product comprising gas, liquid, and solid hydrocarbon components, where the liquid hydrocarbon component comprises deasphalted oil and the solid hydrocarbon component comprises mesophase pitch; separating the gas, liquid, and solid hydrocarbon components; directly utilizing the liquid hydrocarbon component for petrochemicals production; and directly utilizing the solid hydrocarbon component for carbon artifact production.

In some embodiments of the method, the crude oil is crude oil received directly from a wellhead after being separated from natural gas and dewatered, but otherwise not pretreated prior to the step of supplying crude oil to the reactor vessel. Still in other embodiments, the predetermined temperature is between about 350 degrees Centigrade (° C.) and about 575° C. In some embodiments, the predetermined temperature is between about 400° C. and about 450° C. In yet other embodiments, the method further comprises the step of pressurizing the vessel to an initial pressure between about 145 pounds per square inch gauge (psig) and about 870 psig before the step of heating the crude oil in the reactor vessel to a predetermined temperature for a predetermined amount of time.

Still in other embodiments, the step of pressurizing the vessel to an initial pressure includes evacuating oxygen from the reactor vessel using a gas comprising nitrogen. In certain embodiments, the method further comprises the step of pressurizing the vessel to an initial pressure between about 435 psig and about 725 psig before the step of heating the crude oil in the reactor vessel to a predetermined temperature for a predetermined amount of time. In some embodiments, the step of pressurizing the vessel to an initial pressure includes evacuating oxygen from the reactor vessel using a gas comprising nitrogen. Still in other embodiments, the predetermined amount of time is between about 2 hours and about 15 hours. In certain embodiments of the method, the predetermined amount of time is between about 4 hours and about 8 hours.

In other embodiments, the step of reducing asphaltene content reduces the asphaltene content in the deasphalted oil to less than about 2% by weight. In certain other embodiments, the elevated pressure is greater than about 1,000 psig. Still in other embodiments, the elevated pressure is between about 1,800 psig and 1,900 psig. In certain embodiments of the method, the step of directly utilizing the liquid hydrocarbon component for petrochemicals production includes the step of supplying the deasphalted oil to a fluidized catalytic cracking process. In certain embodiments, the step of directly utilizing the liquid hydrocarbon component for petrochemicals production includes the step of supplying the deasphalted oil to a steam cracking process.

Still in yet other embodiments, the step of directly utilizing the solid hydrocarbon component for carbon artifact production includes the step of producing carbon fiber from the mesophase pitch. In certain embodiments, the crude oil comprises at least one hydrocarbon selected from the group consisting of: heavy crude oil; light crude oil; and crude oil residue with a boiling point greater than about 500° C.

Still in other embodiments, an asphaltene compound content of the deasphalted oil is reduced by at least about 50% by mass relative to an asphaltene compound content of the crude oil. In certain embodiments, an asphaltene compound content of the deasphalted oil is reduced by at least about 90% by mass relative to an asphaltene compound content of the crude oil. Still in alternative embodiments, a metal content in the liquid hydrocarbon component is less than a metal content in the crude oil. In some embodiments, the solid hydrocarbon component is at least about 90% pure mesophase pitch. And in other embodiments, the step of reducing asphaltene content in the crude oil by allowing polymerization reactions to occur in the reactor vessel at an elevated pressure in the absence of oxygen increases pressure in the reactor vessel to between about 1,700 psig and about 2,500 psig.

Further disclosed herein is an integrated system for mesophase pitch and petrochemicals production, the system including a crude oil supply fluidly coupled to a reactor vessel, the reactor vessel operable to be heated to a predetermined temperature for a predetermined amount of time, and operable to reduce asphaltene content in the crude oil supply by allowing polymerization reactions to occur in the reactor vessel at an elevated pressure in absence of oxygen; a three-phase gas, liquid, solid separator operable to separate a three-phase upgraded hydrocarbon product produced in the reactor vessel, the three-phase upgraded hydrocarbon product comprising gas, liquid, and solid hydrocarbon components, where the liquid hydrocarbon component comprises deasphalted oil and the solid hydrocarbon component comprises mesophase pitch; and a cracking unit, where the cracking unit is fluidly coupled to receive the liquid hydrocarbon component and to crack the liquid hydrocarbon component for petrochemicals production.

In some embodiments of the system, the system further comprises a unit to produce carbon fiber from the mesophase pitch. In some embodiments, the predetermined temperature is between about 350° C. and about 575° C. Still in other embodiments, the predetermined temperature is between about 400° C. and about 450° C. In yet other embodiments, the predetermined amount of time is between about 2 hours and about 15 hours. In certain embodiments, the predetermined amount of time is between about 4 hours and about 8 hours. In some embodiments, asphaltene content in the deasphalted oil is less than about 2% by weight. Still in other embodiments, the elevated pressure is greater than about 1,000 psig. In certain embodiments, the elevated pressure is between about 1,800 psig and 1,900 psig. In yet other embodiments, the cracking unit includes a fluidized catalytic cracking process.

In certain embodiments, the cracking unit includes a steam cracking process. Still in other embodiments, the crude oil comprises at least one hydrocarbon selected from the group consisting of: heavy crude oil, light crude oil, and crude oil residue with a boiling point greater than about 500° C. In embodiments of the system, an asphaltene compound content of the deasphalted oil is reduced by at least about 50% by mass relative to an asphaltene compound content of the crude oil supply. Still in other embodiments, an asphaltene compound content of the deasphalted oil is reduced by at least about 90% by mass relative to an asphaltene compound content of the crude oil supply. In some embodiments, a metal content in the liquid hydrocarbon component is less than a metal content in the crude oil supply.

In other embodiments of the system, the solid hydrocarbon component is at least about 90% pure mesophase pitch. Still in certain embodiments, the elevated pressure in the reactor vessel is between about 1,700 psig and about 2,500 psig.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION

So that the manner in which the features and advantages of the embodiments of systems and methods of integrated processes for mesophase pitch and petrochemicals productions, as well as others, which will become apparent, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Figure 1:
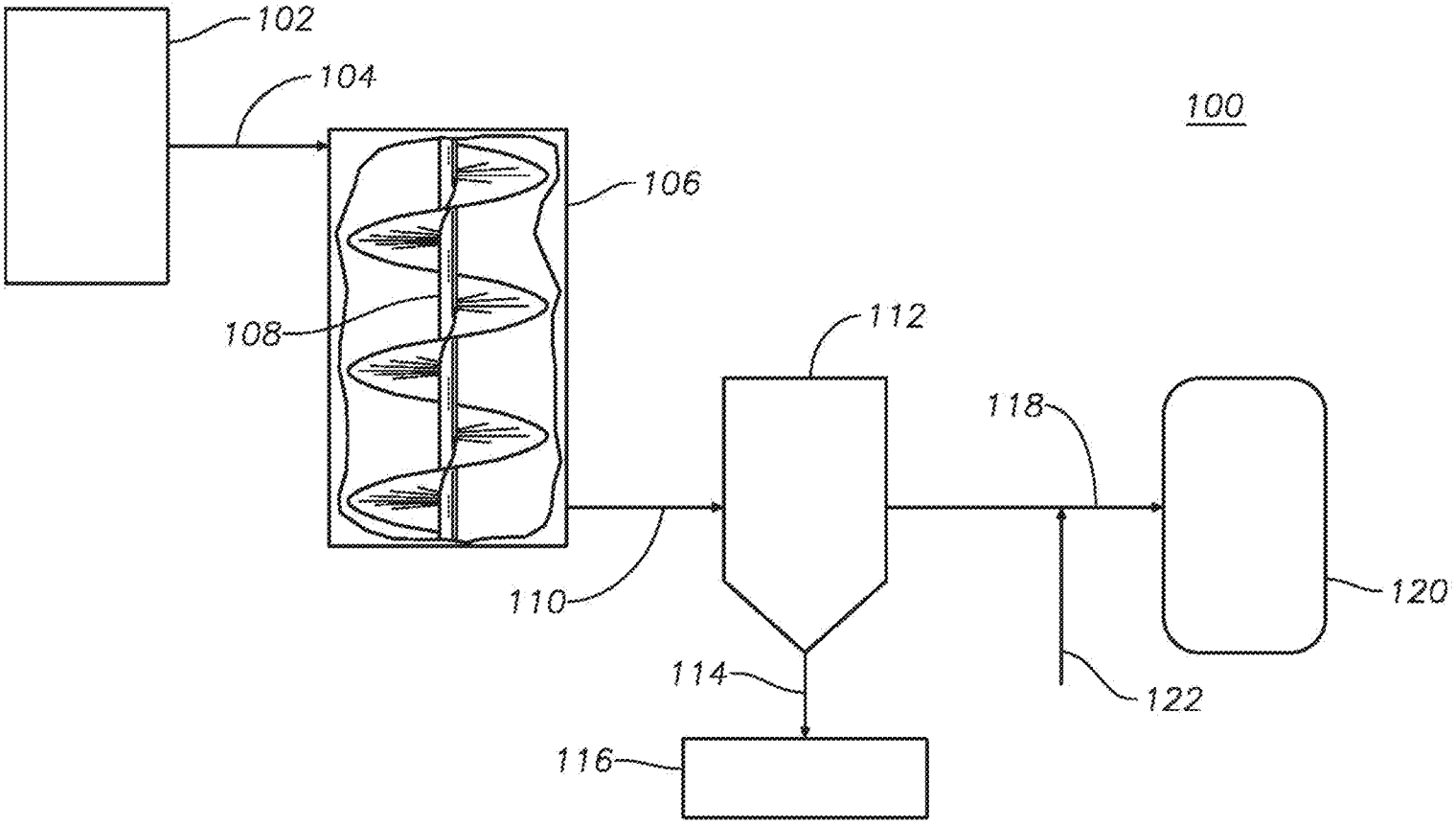
FIG. 1 is a mechanical flow diagram showing a system and method for one example embodiment of a direct C2C production process.

Referring first to FIG. 1, a mechanical flow diagram is provided showing a system and method for one example embodiment of a direct crude-to-chemicals (C2C) production process. In embodiments of the present disclosure, different scenarios are shown for an integrated thermal pretreatment process to produce mesophase pitch (MP) in addition to upgraded crude oil with very low concentrations of asphaltenes and heavy metals, also referred to as deasphalted oil or DAO. Products, such as MP can be directly used for carbon fiber production, and DAO can be used as a direct feed in C2C technologies, for example in fluid catalytic cracking (FCC) and pyrolysis (steam cracking). Embodiments of the thermal pretreatment step involve extended thermal polymerization under mild cracking conditions. The result is MP, gaseous cracking products, and liquid DAO. Liquid and gas products can be fractionated into petrochemicals feedstocks or used as feeds for direct C2C processes. The processes can be integrated with conventional steam/catalytic cracking systems to provide solutions for the challenges cited previously, such as metal poisoning of catalysts and coke precursors.

The term crude oil in the present disclosure includes reference to liquid crude oil from the wellhead separated from natural gas. As defined, crude oil feeds of the present disclosure can undergo treatment processes to render the feeds suitable for transportation, such as desalting; however, in certain embodiments crude oil feed inlets do not undergo any distillation or fractionation pre-treatment of any kind. Crude oil can include Arabian light, Arabian extra light, Arabian heavy, and other types of crude oils with American Petroleum Institute (API) numbers varying from about 39° to about 6°, or varying from about 30° to about 6°, or varying from about 21° to about 6°. In some embodiments described here, "thermal" pretreatment of the crude oil occurs at elevated temperatures and elevated pressures under a substantially inert atmosphere, for example nitrogen, or an inert atmosphere, for example argon, but in some embodiments of the thermal pretreatment step, no solvents and no other chemical reactants are added to the crude oil.

The American Petroleum Institute (API) gravity is a measure of how "heavy" or "light" a petroleum liquid is. The relationship between API gravity and specific gravity (SG) at 60° F. is API=(141.5/SG)−131.5. Crude oil from Saudi Arabia with API gravity greater than about 32° is called Arabian light or "AL" and crude oil with API gravity lesser than about 28° is called Arabian heavy or "AH." Throughout the present disclosure, hydrotreated ("HT") residue of Arabian light crude oil is also referred to as "C2C" (crude-to-chemical) rejects, and the terms identify the residue obtained with a boiling point greater than about 500° C. after hydrotreating Arabian light crude oil. For example, in one scale, Arabian heavy is about 10°≥API>6°; Arabian medium is about 21°≥API>10°; Arabian light is about 30°≥API>21°; and Arabian extra light is about 39°≥API>30°.

As shown in FIG. 1, process 100 begins with an untreated crude oil supply 102 from a wellhead separated from natural gas, optionally de-salted and stabilized for transport, but otherwise untreated, not fractionated, and not cracked. Embodiments of a thermal pretreatment step for crude oil supply 102 include heating untreated crude oil supply 102 under inert atmosphere or substantially inert atmosphere, the atmosphere being substantially oxygen free (for example less than about 5% by volume oxygen, or less than about 1% by volume oxygen). As shown in FIG. 1, the substantially inert atmosphere can include nitrogen gas in addition to or alternative to one or more inert gases, for example argon or helium. Hydrogen ($H_2$) and other treatment additives can optionally be added to untreated crude oil supply 102, but are not required.

Embodiments of processes of the disclosure include thermal treatment under inert nitrogen or argon or helium atmosphere, without additional additives. However, additives may be added to inert gas flow or to crude oil feed to improve polymerization yield and to adjust the properties of mesophase pitch (for example lessening its softening point). Optional additives can include hydrogen in addition to or alternative to organic salts.

Inlet crude oil enters at inlet 104 to a high pressure high temperature (HPHT) heating reactor 106, which is optionally under agitation by agitator 108. A certain volume of crude oil enters HPHT heating reactor 106 to allow a void space near the top of HPHT heating reactor 106, the volume of which can be varied and occupied by nitrogen in addition to or alternative to other inert gases. A void space with inert or substantially inert atmosphere may occupy between about 10 volume percent and about 80 volume percent of HPHT heating reactor 106, or between about 30 volume percent and about 50 volume percent of HPHT heating reactor 106. HPHT heating reactor 106, in some embodiments, is heated to and maintained at a predetermined (pre-selected) reaction temperature between about 350° C. to about 575° C., or between about 400° C. to about 450° C.

HPHT heating reactor 106 is maintained initially, prior to heating, at a pressure of about 145 pounds per square inch gauge (psig) to about 870 psig, or about 435 psig to about 725 psig, under inert or substantially inert atmosphere in the absence of oxygen, and during heating the residence time is maintained between about 2 hours and about 15 hours, or about 4 hours and about 8 hours. During heating, pressure within HPHT heating reactor 106 can reach greater than about 1,000 psig, and can be between about 1,700 psig and about 2,500 psig.

Effluent at reactor outlet 110 proceeds to a gas, liquid, solid three-phase separator 112, and the effluent is separated in three-phase separator 112 into a gaseous stream comprising hydrocarbons, a liquid DAO stream, and a substantially solid MP product. MP proceeds by outlet 114 to MP product collection 116. The MP can be used as a valuable byproduct in an integrated carbon fiber spinning, or any other carbon artifact, facility to convert MP into valuable carbon fibers and electrode materials for batteries.

Gaseous products are cracking products which range from $C_1$-$C_5$ paraffins and olefins, in addition to hydrogen, methane, ethane, propylene, propane, butanes and butenes, pentanes and pentenes. Three-phase separator 112 separates products by density, where gaseous products are vented off proximate the top of three-phase separator 112, while solids and liquids are separated by methods like centrifugation in addition to or alternative to sedimentation, for example.

DAO from the process exits by outlet 118 to a direct C2C refinement process 120, which can include for example FCC in addition to or alternative to steam cracking (pyrolysis). DAO in embodiments of the present disclosure can contain less than about 2% asphaltenes by weight and can be used as steam/catalytic cracking feed for petrochemicals production.

For the purpose of heat integration, in one example, crude oil can be first preheated in the tubes of the convection section of a pyrolysis oven or in the regeneration section of an FCC unit to less than cracking temperatures, for example between about 100° C. to about 350° C., or between about 250° C. to about 350° C., or between about 200° C. to about 300° C., or less than about 200° C. depending on the type of crude oil feed. The preheated oil is then fed to a deasphalting unit, such as for example HPHT heat treatment reactor 106, where it is thermally treated under pressure to produce mesophase pitch, liquid deasphalted oil, and gaseous cracking products which are separated in a three-phase separator, such as for example three-phase separator 112. In some embodiments, DAO can be mixed with superheated steam (from a convection zone or regeneration section of a FCC), for example using an optional superheated steam stream 122 as shown in FIG. 1, and fed to the final preheating zone before severe cracking.

The upgraded deasphalted crude oil in addition to or alternative to its residue can be used as feed for hydrocarbon cracking processes such as steam pyrolysis and catalytic fluidized cracking, while asphaltenes in the crude oil residue are removed simultaneously with the production of high quality MP. Removal of asphaltenes from DAO is advantageous, as these compounds cause reactor coking in steam pyrolysis and FCC processes. Superior selectivity for light olefins, especially ethylene and propylene, was observed when the DAO from an example thermal treatment step of the present disclosure was used as a cracking feed.

Experiments

In certain experiments, a 10 liter autoclave reactor was charged with Arabian heavy crude oil, and a void space with substantially inert atmosphere was allowed to remain in the upper portion of the autoclave. The autoclave was flushed several times with nitrogen gas ($N_2$) to remove oxygen from the reaction environment. The autoclave was maintained under $N_2$ pressure at about 600 pounds per square inch gauge (psig) at room temperature. The reactor temperature was increased by 6 degrees centigrade/minute (° C./min) to desired temperatures (for example about 400° C., 410° C., and 425° C.) under stirring at about 600 rpm. When the desired, pre-determined reaction temperature was reached, heat treatment was maintained for a predetermined polymerization time, optionally between about 6 and about 17 hours. The time for heat treatment can also be between about 2 hours and about 15 hours, or between about 4 hours and about 8 hours. Pressures within the autoclave reactor reached over 1,000 psig, to about between 1,800 psig and about 1,900 psig. The obtained product consisted of three separate phases: gas, liquid, and solid at room temperature. Cracking gases were vented, and MP was separated from DAO by centrifugation.

For certain other, but similar experiments, Table 1 shows values for saturated hydrocarbons, aromatics, resins, and asphaltenes for Arabian heavy crude oil, thermally treated Arabian heavy crude oil, hydrotreated crude oil residue, and thermally treated hydrotreated crude oil residue.

TABLE 1

Saturated carbon, aromatic, resin, and asphaltene (SARA) fractions of crude oil and hydrotreated crude oil residue before and after treatment.

| Sample ID | Saturates (wt. %) | Aromatics (wt. %) | Resins (wt. %) | Asphaltene (wt. %) |
|---|---|---|---|---|
| Arabian Heavy (AH) | 32.4 | 35.4 | 21.8 | 10.8 |
| Arabian Heavy Thermally Treated Liquid Cut | 9.57 | 78.3 | 10.94 | 1.19 |
| Arabian Light hydrotreated (HT) Residue | 31.8 | 60 | 5.1 | 3.1 |
| Arabian Light HT Residue Thermally Treated Liquid Cut | 34.6 | 58.4 | 5.2 | 1.8 |

Crude oil or its derivatives can be separated into four chemical group classes, namely saturates such as alkanes and cycloparaffins, aromatics, resins, and asphaltenes, the so-called SARA fractions. SARA analysis is used to determine the distribution of saturates, aromatics, resins, and asphaltene in topped petroleum samples. The procedure is divided into two stages: The first stage involves the precipitation and quantification of asphaltenes, while the second stage is the open-column chromatographic separation of the deasphalted oil into saturate, aromatic, and resin fractions following the ASTM D-2007 method.

Notably, Table 1 shows that the Arabian Heavy (AH) thermally treated product had been deasphalted, as about 90% of the asphaltenes have been removed. As shown in Table 1, a large portion of the asphaltenes content is removed after processing the crude oil. Also shown in Table 1 is the reduction in resins content by about half for Arabian heavy crude. For Arabian heavy, aromatics content increased by more than 100% from 35 weight % to 78 weight %.

Table 2 shows elemental analysis of both Arabian heavy crude oil and its thermally treated product. The mesophase pitch hydrocarbon product obtained (liquid+solid) also contained much less sulfur, nickel, and other metals, such as for example vanadium, than its precursors, which allows the mesophase pitch (solid) and deasphalted oil (liquid) to be suitable for direct crude to chemicals technology via either steam cracking or catalytic cracking processes for DAO, and carbon fiber production for solid MP. In the inductively coupled plasma (ICP) mass spectrometer used for detecting metals, the practical quantitation limit (QPL) for the sample weight used (30 milligrams, mg) was: nickel=0.05 mg, sulfur=0.4 mg, and vanadium=0.05 mg.

TABLE 2

Elemental analysis of both Arabian heavy crude oil and its thermally treated product (mesophase pitch).

| Sample ID | Inductively Coupled Plasma (ICP) Mass Spectrometry | Ni (mg) | S (mg) | V (mg) |
|---|---|---|---|---|
| Treated Arabian Heavy | Liquid | Not Detected | 2.34 | Not Detected |
| | Solid | 0.0175 | 0.79 | 0.005 |
| Arabian Heavy Crude | Whole | 0.0021 | 3.29 | 0.006 |

As shown in Table 2, the heavy metal content (Ni and V) was not detected in the liquid phase of the obtained product (DAO) (treated Arabian heavy). The sulfur content in the liquid phase was also significantly decreased. The liquid composition analyzed by SIMDIS showed 100% of the components have a boiling point less than 500° C. after the Arabian heavy oil treatment and 96% of the components have a boiling point less than 500° C. after the residue treatment. The volatilities of different components in the crude oil and residue, and in the heat-treated crude oil and heat-treated residue, were measure by the Agilent Simulated Distillation ("SIMDIS") System by Agilent Technologies of Sugar Land, Tex. SIMDIS follows the standard operating procedure (SOP) described in the reference manual and the method incorporates ASTM D7169.

The SIMDIS characterizations show that the obtained DAO liquid contains hydrocarbons with a significantly lower boiling point than the original Arabian heavy crude. Therefore, the hydrocarbon products could be suitable feeds for refining processes, hydrotreating processes, and especially for direct crude-oil-to-chemicals processes. In certain embodiments, different precursors have been tested including Arabian heavy oil and a cut over 500° C. of Arabian light hydrothermally treated. The beginning pressure of a pressure vessel, such as for example an autoclave or any high pressure processing unit, in some embodiments is at least about 600 psig (at room temperature), and then the temperature is raised gradually to about 420° C. During treatment, the pressure in a high pressure vessel could reach between about 1700 psig to about 2500 psig, depending on the volume of the starting feed and the temperatures reached.

Figure 2:
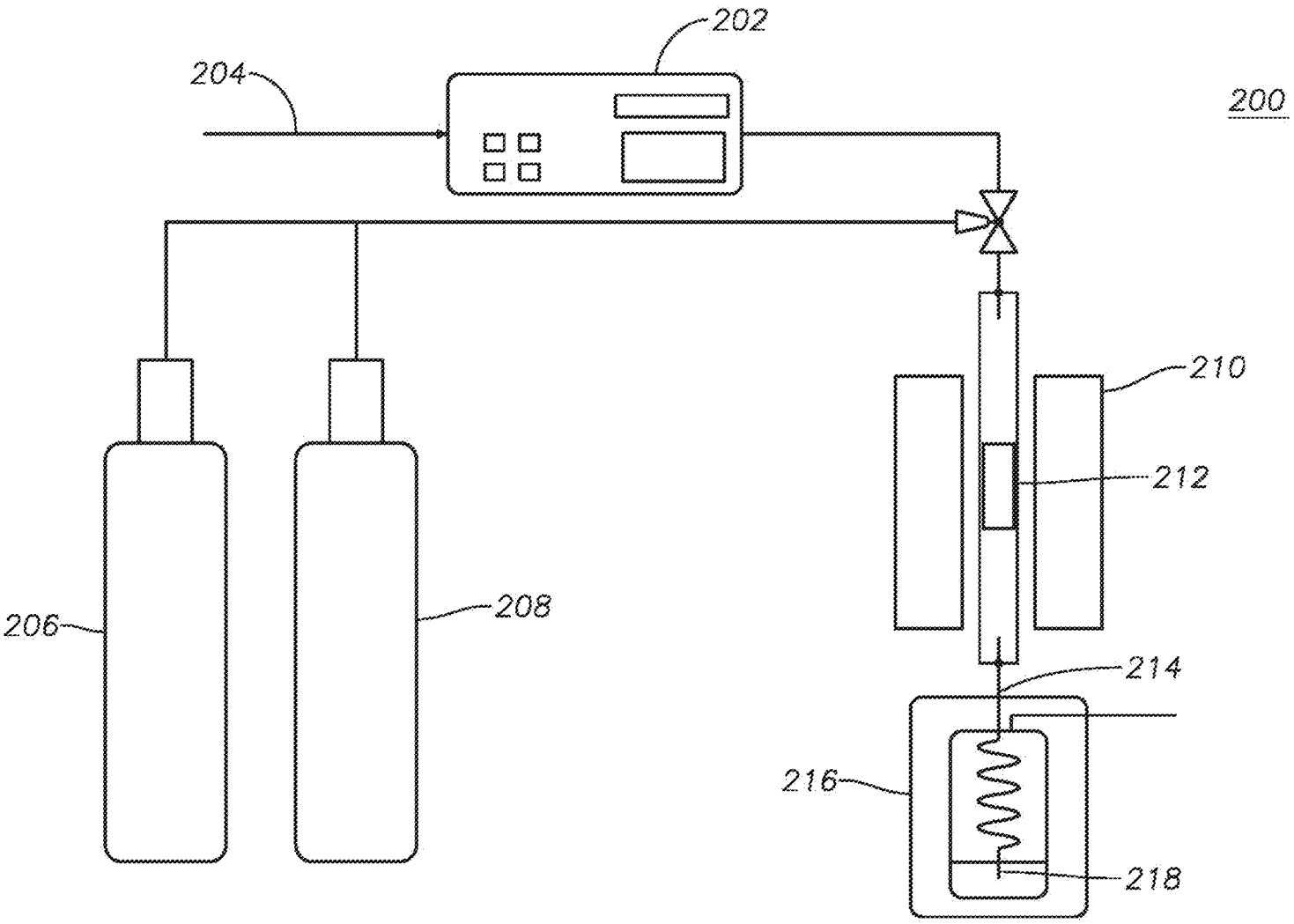
FIG. 2 is a mechanical diagram showing an experimental set-up for a cracking experiment of the present disclosure.
Figure 3:
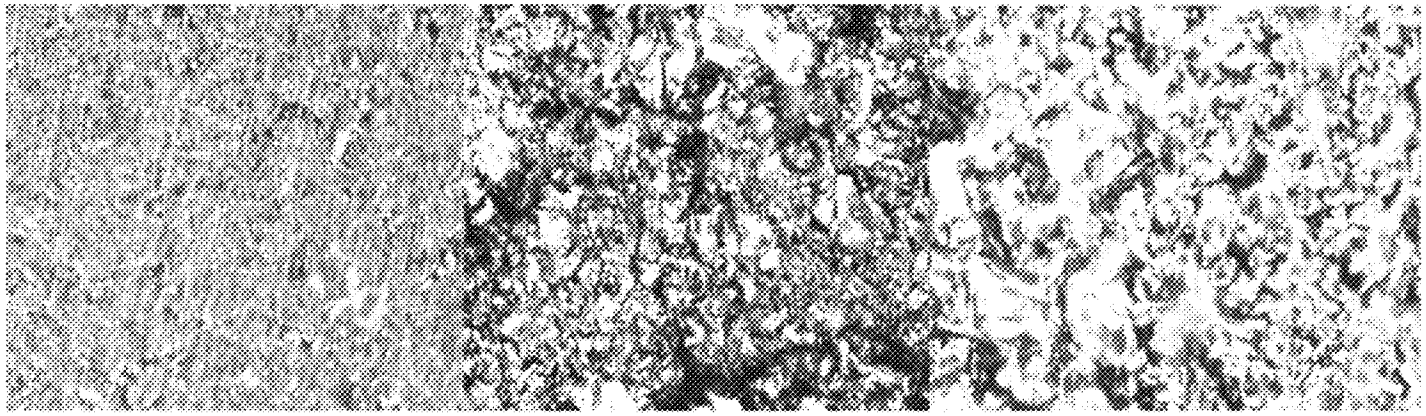
FIG. 3 shows optical microscope images of mesophase pitch obtained using embodiments of the present disclosure at 100 micrometer (μm), 50 μm, and 20 μm scales, where crude oil and crude oil residue samples were treated at a temperature of 425 degrees Centigrade (° C.), and at a stirring rate of 650 rotations per minute (rpm) for 6 hours.

Cracking of DAO is discussed with regard to FIG. 2 as follows, while regarding produced MP in experiments of the present disclosure, FIG. 3 shows optical microscope images of solid mesophase pitch obtained at 100 μm, 50 μm, and 20 μm scales, where the mesophase pitch was obtained after treating a sample at a temperature of 425° C., and at a stirring rate of 650 rotations per minute (rpm) for 6 hours. Mesophase pitch produced using embodiments of the present disclosure is a suitable, high-quality precursor for pitch-based carbon fibers. The mesophase pitch obtained includes a suitable amount of alkyl side chains, lesser softening point, and an advantageous, consistent crystalline structure identified using a polarized optical microscope and X-ray diffraction (XRD). The images in FIG. 3 show the mesophase pitch is beneficially homogeneous throughout. Similar results were obtained with optical microscope images for both Arabian heavy and HT residue of Arabian light (C2C reject) starting materials.

The purity of mesophase pitch was determined by the polarized microscope by counting the percentage of the mesophase areas that reflect the light differently than the "non mesophase" areas. The purity of the mesophase pitch in embodiments of the present disclosure can be greater than about 90% and greater than about 99%.

Figure 4:
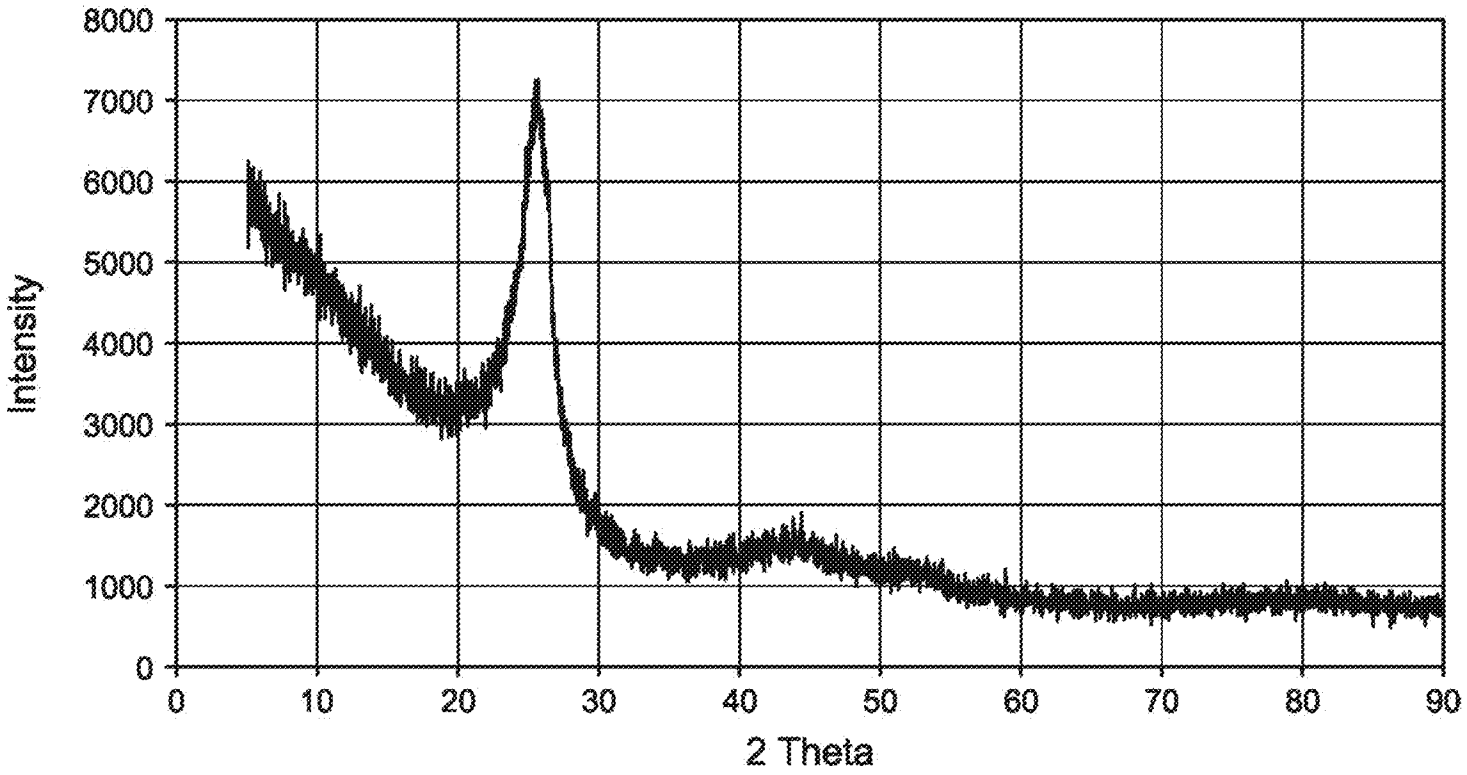
FIG. 4 is a graph showing X-ray diffraction (XRD) data for mesophase pitch obtained using embodiments of the present disclosure, where crude oil and crude oil residue samples were treated at a temperature of 425° C., and at a stirring rate of 650 rotations per minute (rpm) for 6 hours.

FIG. 4 is a graph showing x-ray diffraction (XRD) data for mesophase pitch obtained using embodiments of the present disclosure, where the mesophase pitch was obtained at a temperature of 425° C., and at a stirring rate of 650 rotations per minute (rpm) for 6 hours. The XRD graph shows a peak at 25.6, which identifies mesophase pitch carbon material. Mesophase pitch obtained using the methods described here also contained less asphaltenes than the mesophase pitch precursors, such as crude oil and crude oil residue. In some embodiments, up to about 90% asphaltenes removal was realized and mesophase pitch suitable for C2C applications, such as carbon fibers, was obtained. The final product characterization with XRD shows the usual diffraction graph for mesophase pitch, which is described as going through heated polymerization of aromatic compounds and resin compounds in crude oil into greater molecular weight molecules.

In certain embodiments of the present technology, thermal treatment is carried out in the absence of or without any additive other than nitrogen in addition to or alternative to one or more inert gases to pressurize the thermal treatment process. In some embodiments, a greater than about 90% pure mesophase pitch product is obtained after thermal treatment, and in some embodiments a greater than about 99% pure mesophase pitch product is obtained after thermal treatment. Crude oil and HT crude oil residues can be upgraded and deasphalted simultaneously using pressurized thermal treatments of the present disclosure.

Referring now to FIG. 2, a mechanical diagram is provided showing an experimental set-up for a direct C2C cracking experiment of the present disclosure. In experimental set-up 200, a syringe pump 202 was used to feed DAO from DAO inlet 204 with helium as a carrier gas from helium tank 206 (which can be in addition to or alternative to nitrogen gas in nitrogen tank 208). DAO was produced using embodiments described in the experiments previously. The weight hourly space velocity (WHSV) used in the cracking experiments was 6 1/hour ($h^{-1}$). Experimental set-up 200 further included an electric furnace 210, cracking catalyst 212, gas chromatograph 214, and a condenser 216. Liquid products were collected at product outlet 218. Gases were analyzed by gas chromatography (GC). Carbon monoxide, carbon dioxide, oxygen, nitrogen, methane, light olefins, $C_1$ to $C_7$ hydrocarbons and BT (Benzene and Toluene) can be quantified.

Cracking temperatures can range from about 450° C. to about 850° C., for example in catalytic cracking such as FCC from about 500° C. to about 650° C. depending on the feed type, and for example in steam cracking from about 650° C. to about 850° C. Cracking catalyst used in some embodiments includes a solid acid catalyst. In one or more embodiments, the solid acid catalyst bed may include an aluminosilicate zeolite, a silicate (for example, silicalites), or a titanosilicate. In further embodiments, the solid acid catalyst is an aluminosilicate zeolite having a Mordenite Framework Inverted (MFI) structure.

For example and not by way of limitation, the MFI structured aluminosilicate zeolite catalyst may be a Zeolite Socony Mobil-5 (ZSM-5) catalyst. In a further embodiment, the ZSM-5 catalyst may be an H-ZSM-5 catalyst where at least a portion of the ZSM-5 catalyst ion exchange sites are occupied by H+ ions. Moreover, the aluminosilicate zeolite catalyst, for example, the H-ZSM-5 catalyst, may have a Si/Al molar ratio of at least 10. In further embodiments, aluminosilicate zeolite catalyst may have a Si/Al molar ratio of at least 30, or at least 35, or at least 40. Additionally, the aluminosilicate zeolite catalyst may also include one or more additional components used to modify the structure and performance of the aluminosilicate zeolite catalyst. Specifically, aluminosilicate zeolite catalyst may include phosphorus, boron, nickel, iron, tungsten, other metals, or combinations thereof. In various embodiments, the aluminosilicate zeolite catalysts may comprise 0-10% by weight additional components, 1-8% by weight additional components, or 1-5% by weight additional components.

For example and not by way of limitation, these additional components may be wet impregnated in the ZSM-5 followed by drying and calcination. The aluminosilicate zeolite catalysts may contain mesoporous structures. The catalyst may be sized to have a diameter of 25 to 2,500 micrometers (μm). In further embodiments, the catalyst may have a diameter of 400 to 1200 μm, 425 to 800 μm, 800 to 1000 μm, or 50 to 100 μm. The minimum size of the catalyst particles depends on the reactor design to prevent passage of catalyst particles through the filter with reaction products.

In Table 3 that follows, the feasibility of cracking the DAO was demonstrated, and the production of valuable products was shown.

TABLE 3

Example conversions, yields, and selectivity for DAO produced using embodiments of the disclosure.

| Feedstock | DAO of Heavy Crude Oil | DAO of Residue (Greater than 500° C. cut) of HT Arabian light crude | Heavy Crude Oil |
|---|---|---|---|
| WHSV ($h^{-1}$) | 5.9 | 5.9 | 5.9 |
| Conversion (wt. %) * | 32.9 | 33.3 | 26.8 |
| Yield to Olefins (wt. %) | 20.4 | 21.0 | 17.9 |
| Yield to Ethylene (wt. %) | 4.9 | 4.7 | 4.7 |
| Yield to Propylene (wt. %) | 11.4 | 11.8 | 9.9 |
| Yield to C4 olefins (wt. %) ** | 4.1 | 4.5 | 3.4 |
| Selectivity *** to olefins (wt. %) | 62.0 | 63.0 | 66.3 |
| Selectivity *** to Ethylene (wt. %) | 14.9 | 14.2 | 17.5 |
| Selectivity *** to Propylene (wt. %) | 34.7 | 35.5 | 36.7 |
| Selectivity *** to C4 olefins ** (wt. %) | 12.4 | 13.4 | 12.1 |

In Table 3, conversion * refers to the amount of gas phase formed from DAO in the cracking reaction carried out in the device of FIG. 2; C4 olefins  refers to 1-butene, cis and trans-2-butene, and isobutene; and selectivity * only considers the gas phase products formed. In the present disclosure, processes and steps prior to cracking or other downstream chemical manufacture steps, such as production of carbon fiber, do not target evaporating or otherwise separating out undesirable components of a crude oil feed, but instead target extended thermal polymerization, under pressure, of nonvolatile aromatic rings in asphaltic fractions so they can be precipitated and separated easily, for example as mesophase pitch. Controlling reaction temperature, pressure, and residence time ensures reproducibility and flexibility.

Certain advantages enabled by methods and systems of the present disclosure include: reducing the problem of coke precipitation in steam crackers for crude oil and heavy feedstocks; reducing the problem of rapid catalyst deactivation by coke; reducing the problem of metals in crude oil poisoning cracking catalysts; co-production of MP boosts the process economics; and higher hydrocarbon yields compared to cracking products from conventional refining methods such as using naphtha and vacuum gas oil (VGO). It is believed that treatment at high temperatures at about 400° C. or above, the branching of aromatics in addition to or alternative to asphaltenes are cracked into lower molecular weight hydrocarbons and more hydrocarbons can be utilized for catalytic cracking.

What is claimed is:

1. An integrated system for mesophase pitch and petrochemicals production, the system comprising:

a crude oil supply fluidly coupled to a reactor vessel, the reactor vessel operable to be heated to a predetermined temperature for a predetermined amount of time, and operable to reduce asphaltene content in the crude oil supply by allowing polymerization reactions to occur in the reactor vessel at an elevated pressure in absence of oxygen, wherein the reactor vessel maintains a void space to be occupied by nitrogen in addition to or alternative to other inert gases between about 10 volume percent and about 80 volume percent of the reactor vessel apart from the crude oil supply during heating to between about 350° C. and about 575° C. and a pressure greater than 1,000 psig;

a three-phase gas, liquid, solid separator operable to separate a three-phase upgraded hydrocarbon product produced in the reactor vessel, the three-phase upgraded hydrocarbon product comprising gas, liquid, and solid hydrocarbon components, where the liquid hydrocarbon component comprises deasphalted oil and the solid hydrocarbon component comprises mesophase pitch; and a cracking unit, where the cracking unit is fluidly coupled to receive the liquid hydrocarbon component and to crack the liquid hydrocarbon component for petrochemicals production.

2. The system according to claim 1, further comprising a unit to produce carbon fiber from the mesophase pitch.

3. The system according to claim 1, where the predetermined temperature is between about 350° C. and about 575° C.

4. The system according to claim 1, where the predetermined temperature is between about 400° C. and about 450° C.

5. The system according to claim 1, where the predetermined amount of time is between about 2 hours and about 15 hours.

6. The system according to claim 1, where the predetermined amount of time is between about 4 hours and about 8 hours.

7. The system according to claim 1, where asphaltene content in the deasphalted oil is less than about 2% by weight.

8. The system according to claim 1, where the elevated pressure is greater than about 1,000 psig.

9. The system according to claim 1, where the elevated pressure is between about 1,800 psig and 1,900 psig.

10. The system according to claim 1, where the cracking unit includes a fluidized catalytic cracking process.

11. The system according to claim 1, where the cracking unit includes a steam cracking process.

12. The system according to claim 1, where the crude oil comprises at least one hydrocarbon selected from the group consisting of: heavy crude oil, light crude oil, and crude oil residue with a boiling point greater than about 500° C.

13. The system according to claim 1, where an asphaltene compound content of the deasphalted oil is reduced by at least about 50% by mass relative to an asphaltene compound content of the crude oil supply.

14. The system according to claim 1, where an asphaltene compound content of the deasphalted oil is reduced by at least about 90% by mass relative to an asphaltene compound content of the crude oil supply.

15. The system according to claim 1, where a metal content in the liquid hydrocarbon component is less than a metal content in the crude oil supply.

16. The system according to claim 1, where the solid hydrocarbon component is at least about 90% pure mesophase pitch.

17. The system according to claim 1, where the elevated pressure in the reactor vessel is between about 1,700 psig and about 2,500 psig.

* * * * *